US011944138B2

(12) United States Patent
Tsuei et al.

(10) Patent No.: US 11,944,138 B2
(45) **Date of Patent: *Apr. 2, 2024**

(54) FACE MASK AND METHOD FOR MANUFACTURING THEREOF

(71) Applicant: Alexander Chieruen Tsuei, Woodbury, MN (US)

(72) Inventors: Alexander Chieruen Tsuei, Woodbury, MN (US); Angie Carol Tsuei, Woodbury, MN (US); Feng-Yi Tsuei, Woodbury, MN (US)

( * ) Notice: Subject to any disclaimer, the term of this patent is extended or adjusted under 35 U.S.C. 154(b) by 14 days.

This patent is subject to a terminal disclaimer.

(21) Appl. No.: 17/862,685

(22) Filed: Jul. 12, 2022

(65) Prior Publication Data

US 2022/0346473 A1 Nov. 3, 2022

Related U.S. Application Data

(63) Continuation-in-part of application No. 16/542,594, filed on Aug. 16, 2019, now Pat. No. 11,122,841.

(51) Int. Cl.
*A41D 13/11* (2006.01)

(52) U.S. Cl.
CPC ..... *A41D 13/1161* (2013.01)

(58) Field of Classification Search
CPC ..... A41D 13/1107; A41D 13/113; A41D 13/1115; A41D 13/11; A41D 13/1123; A41D 13/1138; A41D 13/1192; A41D 13/1161; A41D 13/1176; A41D 13/1146; A62B 18/02; A62B 23/025; A62B 7/10
See application file for complete search history.

(56) References Cited

U.S. PATENT DOCUMENTS 2,447,450 A * 8/1948 Williams ..... A41D 13/1161 128/206.16
2,751,905 A * 6/1956 Creelman ..... A41D 13/11 128/206.19
3,500,825 A * 3/1970 Andersson ..... A41D 13/11 128/206.19
4,641,379 A * 2/1987 Martin ..... A41D 13/1161 128/206.28

(Continued)

FOREIGN PATENT DOCUMENTS

DE 202020103171 U1 * 8/2020
DE 202020106698 U1 * 5/2021

(Continued)

*Primary Examiner* — Amy Vanatta
(74) *Attorney, Agent, or Firm* — Tommy S F Wang; Wang IP Law Group, P.C.

(57) ABSTRACT

A face mask and a method for manufacturing the face mask are disclosed. The face mask comprises a sheet, a first lateral flap, a second lateral flap, a first loop, a second loop and an elastic film. The sheet comprises a central portion, a first lateral portion, a second lateral portion and an opening. The first lateral flap is coupled to the first lateral portion to form a first chamber. The second lateral flap is coupled to the second lateral portion to form a second chamber. The first loop connects to a first strap and is coupled to the first lateral flap. The second loop connects to a second strap and is coupled to the second lateral flap. The elastic film is coupled to the sheet and covers the opening.

20 Claims, 17 Drawing Sheets

(56) References Cited

U.S. PATENT DOCUMENTS

| | | | | |
|---|---|---|---|---|
| 5,727,544 | A * | 3/1998 | Miura | A41D 13/11 128/206.16 |
| 5,803,077 | A * | 9/1998 | Gazzara | A41D 13/1115 128/206.13 |
| 10,960,238 | B1 * | 3/2021 | Reele | A41D 13/1107 |
| 2004/0173216 | A1 * | 9/2004 | Park | A62B 23/025 128/206.19 |
| 2005/0133036 | A1 * | 6/2005 | Steindorf | A41D 13/11 128/206.13 |
| 2010/0258130 | A1 * | 10/2010 | Wu | A41D 13/1107 128/206.28 |
| 2014/0224261 | A1 * | 8/2014 | Tsuei | B65D 83/0894 156/159 |
| 2015/0173436 | A1 * | 6/2015 | Tsuei | A41D 13/1115 2/424 |
| 2017/0312558 | A1 * | 11/2017 | Wang | A62B 23/025 |
| 2018/0051405 | A1 * | 2/2018 | Shimada | D04H 3/153 |
| 2020/0229520 | A1 * | 7/2020 | Emery | A41D 13/1161 |
| 2022/0015469 | A1 * | 1/2022 | Markarian | A41D 13/1161 |
| 2022/0023682 | A1 * | 1/2022 | Lee | A62B 18/084 |
| 2022/0087336 | A1 * | 3/2022 | Youkhana | A41D 13/1161 |
| 2022/0105369 | A1 * | 4/2022 | Lee | A41D 13/1161 |
| 2022/0211124 | A1 * | 7/2022 | Hunter | A41D 13/1161 |
| 2023/0292858 | A1 * | 9/2023 | Gordon | A41D 13/1115 128/207.11 |

FOREIGN PATENT DOCUMENTS

| | | | | |
|---|---|---|---|---|
| EP | 3944779 | A1 * | 2/2022 | A41D 13/1161 |
| WO | WO-2011116173 | A2 * | 9/2011 | A41D 13/1107 |
| WO | WO-2021191029 | A1 * | 9/2021 | A41D 13/1115 |

* cited by examiner

FACE MASK AND METHOD FOR MANUFACTURING THEREOF

CROSS-REFERENCE TO RELATED APPLICATION

This application claims the priority of non-provisional patent application U.S. patent application Ser. No. 16/542,594 filed Aug. 16, 2019 which is expressly incorporated by reference herein in its entirety.

FIELD OF THE INVENTION

The present invention generally relates to a face mask. More particularly, the present invention relates to a face mask and a method for manufacturing the face mask.

BACKGROUND OF THE INVENTION

Face masks are useful in a number of fields. For example, in the health care field, a face mask may be useful for protecting both the patient and the health care provider from airborne pathogens or for preventing the transfer of pathogens that reside in the bodily fluids or other liquids. Wearing face masks may also be useful in many industrial settings.

Wearing a face mask is usually achieved by putting the ear hooks on the ears (e.g. dust mask or cloth face mask) or tying straps behind the head (e.g. surgical mask). The former is easy to operate but may cause pain on the pinna after long wear. The latter works more complex but provides use flexibility to ensure the best fit of the face mask on the face of wearers of various head sizes. There are not many innovative ways to put on face mask with less stress on ears and use flexibility. A face mask with an improved design on the hanging means and a method of manufacturing the face mask are still desired.

SUMMARY OF THE INVENTION

This paragraph extracts and compiles some features of the present invention; other features will be disclosed in the follow-up paragraphs. It is intended to cover various modifications and similar arrangements included within the spirit and scope of the appended claims.

The present invention discloses a face mask and method of manufacturing the face mask to provide a better fit of the face mask over the wearer face.

A face mask comprises a sheet, a first lateral flap, a second lateral flap, a first loop, a second loop and an elastic film. The sheet comprises a central portion, a first lateral portion, a second lateral portion and an opening. The first lateral flap is coupled to the first lateral portion to form a first chamber. The second lateral flap is coupled to the second lateral portion to form a second chamber. The first loop connects to a first strap and is coupled to the first lateral flap. The second loop connects to a second strap and is coupled to the second lateral flap. The elastic film is coupled to the sheet and covers the opening.

Preferably, the material of the straps may be non-woven, woven, fabrics, felts, foams, films, plastics or elastics.

Preferably, the straps may be porous or non-porous.

According to the present invention, a first connecting end of the first strap is movable in any position on the first loop. A second connecting end of the second strap is also movable in any position on the second loop.

According to the present invention, a first loose end of the first strap on the first loop and a second loose end of the second strap on the second loop are capable of being tied to each other at the back of the wearer's head to ensure the best fit between the face and the face mask.

According to the present invention, at least one portion of the straps on one surface or both surfaces may be coated with a self-adherent cohesive adhesive. The self-adherent cohesive adhesive may be pressure sensitive and removable. The coated self-adherent cohesive adhesive may have a fast initial tack for successful initial cold seal. Preferably, the coated self-adherent cohesive adhesive provides a T-Peel strength of at least 0.1 lb/in. The coated self-adherent cohesive adhesive provides an initial shear strength of at least 1 psi in 30 seconds.

Preferably, at least one portion of the straps may have a width of greater than or equal to 0.25 inches.

According to the present invention, each strap has an elasticity of greater than or equal to that of the corresponding loop when the straps are made of an elastic material.

According to the present invention, the number of the first strap is at least one. The number of the second strap is at least one.

According to the present invention, the elastic film is coupled to the sheet at the periphery of the opening of the sheet. The elastic film has prominent corrugations (toward the wearer's face) at the coupling region, meanwhile the elastic film is pressed alone or together with the sheet to have prominent corrugations at a non-coupling region but adjacent to the opening in order to improve the contacting tightness of the face mask at the nasal area.

Preferably, the lateral flaps may have prominent corrugations (toward the wearer's face) to improve the contacting tightness of the face mask at the cheek area.

A method of manufacturing the face mask mentioned above is also disclosed. The method comprises: cutting the sheet to form the central portion, the first lateral portion, the second lateral portion and the opening; coupling the elastic film to the sheet to cover the opening; coupling the first lateral flap to the first lateral portion to form the first chamber; coupling the second lateral flap to the second lateral portion to form the second chamber; movably connecting an end of the first strap to the first loop and an end of the second strap to the second loop; and coupling the first loop to the first lateral flap and the second loop to the second lateral flap. After coupling the elastic film to the sheet to cover the opening, the method may further comprise pressing the elastic film to have prominent corrugations at a non-coupling region but adjacent to the opening. Also, before coupling the first and second lateral flaps to the first and second lateral portions to form the first and, second chambers, respectively, the method further comprises: pressing the first and second lateral flaps to have prominent corrugations (toward the wearer's face) at the region that the lateral flaps may potentially contact the wearer's face-skin.

Numerous other advantages and features of the present invention will become readily apparent from the following detailed description of disclosed embodiments, from the claims and from the accompanying drawings.

BRIEF DESCRIPTION OF THE DRAWINGS

The objects, features and advantages of the present application will be more readily appreciated upon reference to the following disclosure when considered in conjunction with the accompanying drawings, wherein like reference numerals are used to identify identical components in the various views, and wherein reference numerals with alphabetic characters are utilized to identify additional types, instantiations or variations of a selected component embodiment in the various views, in which.

DETAILED DESCRIPTION OF THE PREFERRED EMBODIMENTS

Figure 1:
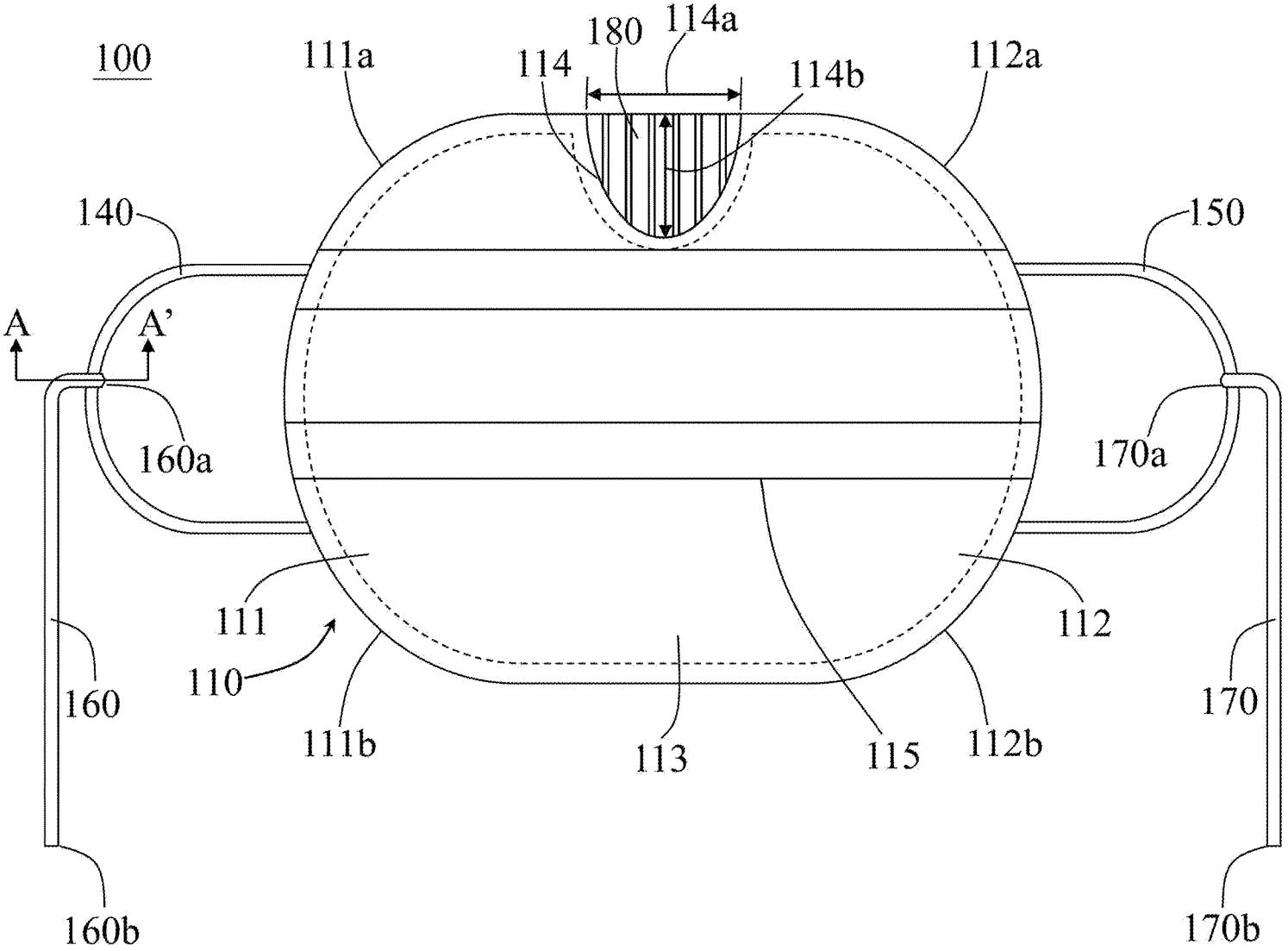
FIG. 1 is a front view of a face mask according to an embodiment.

Reference will now be made in detail to the present representative embodiments of the present application, examples of which are illustrated in the accompanying drawings. Wherever possible, the same reference numbers are used in the drawings and the description to refer to the same or like parts.

Figure 2A:
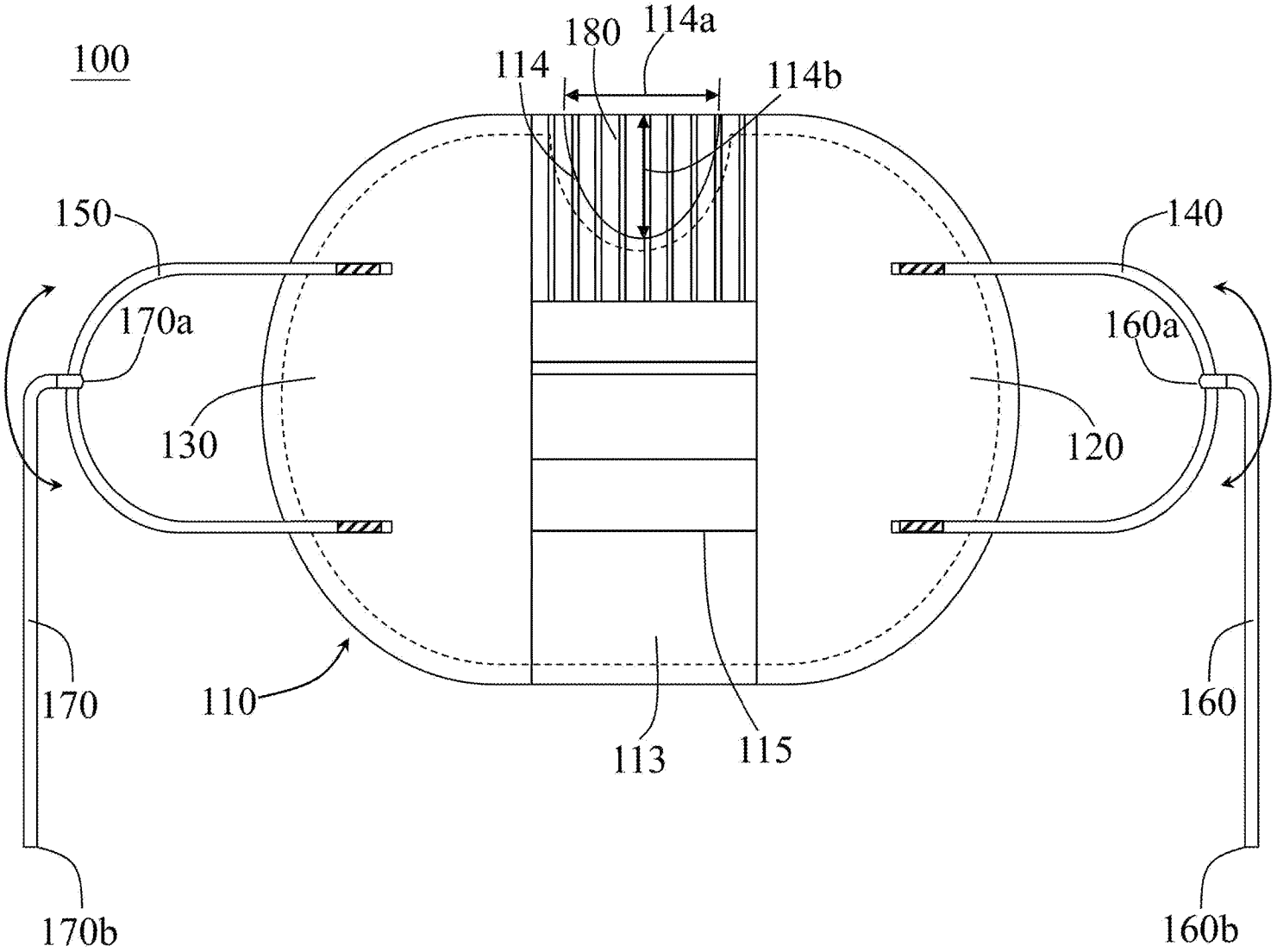
FIG. 2A is a rear view of the face mask with outward earloop according to the embodiment.
Figure 2B:
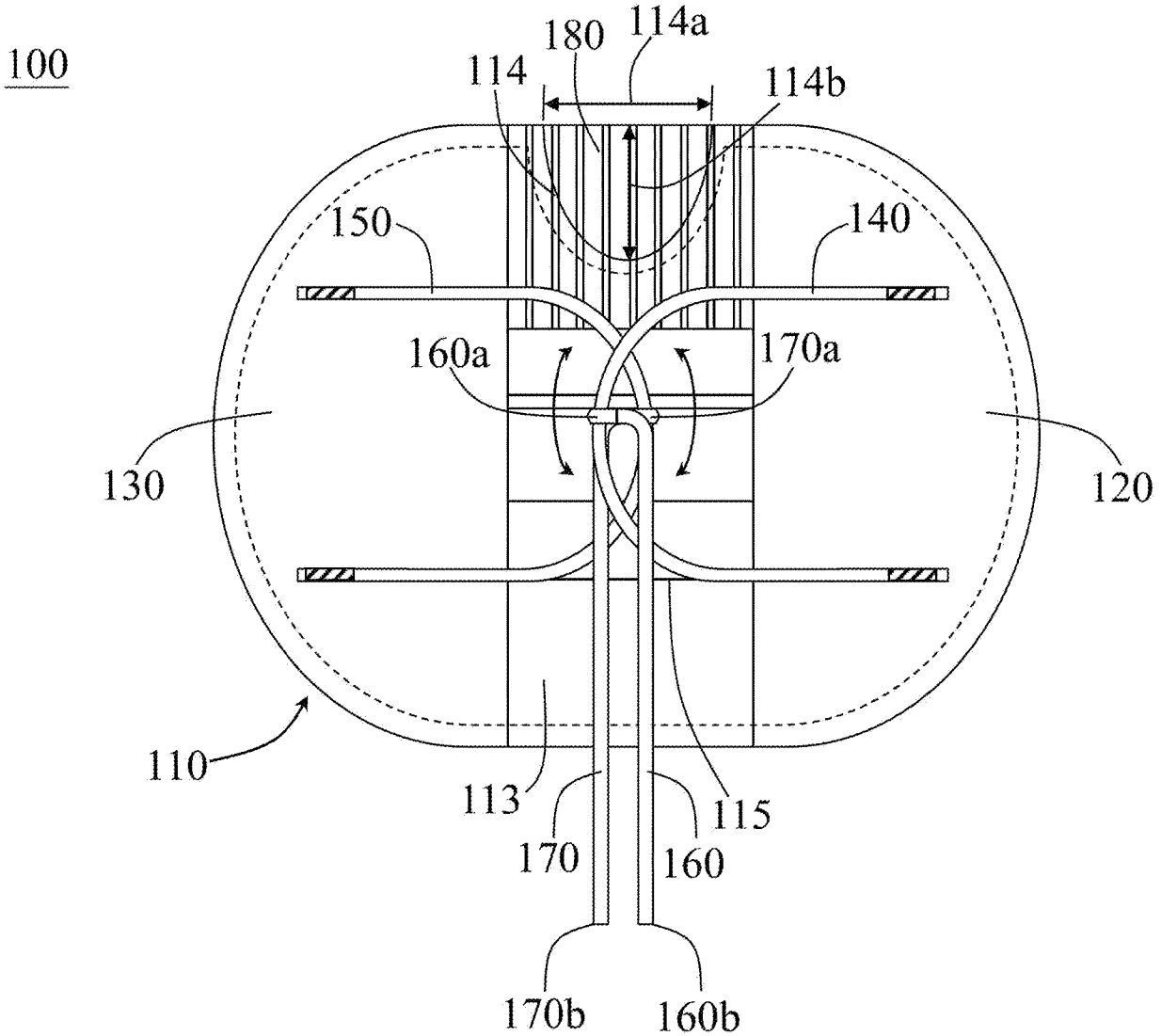
FIG. 2B is a rear view of the face mask with inward earloop according to the embodiment.

FIG. 1 is a front view of a face mask 100 according to an embodiment. FIG. 2A is a rear view of the face mask 100 with outward earloop according to the embodiment. FIG. 2B is a rear view of the face mask 100 with inward earloop according to the embodiment. The face mask 100 comprises a sheet 110, a first lateral flap 120, a second lateral flap 130, a first loop 140, a second loop 150, a first strap 160, a second strap 170 and an elastic film 180.

The sheet 110 comprises a first lateral portion 111, a second lateral portion 112, a central portion 113, an opening 114 and at least one pleat 115. In addition, the sheet 110 in the present embodiment is a filtering web as an example but is not limited thereto. In other embodiments, the material of the sheet 110 of the face mask 100 may be an air-impermeable material. When the air-impermeable material is applied, it is required that the material of the first lateral flap 120 and the second lateral flap 130 of the face mask 100 a filter material for ventilation.

The first lateral portion 111 comprises two corners 111*a*/111*b* at a side opposite to the central portion 113. The corner 111*a* is closer to the opening 114 while the corner 111*b* is farther from the opening 114. The second lateral portion 112 comprises two corners 112*a*/112*b* at a side opposite to the central portion 113 as well. The corner 112*a* is closer to the opening 114 while the corner 112*b* is farther from the opening 114. The corner 111*a* and the corner 112*a* are curved. A curved shape is preferred to accommodate requirements of the face masks for peripheral vision and acuity because vision of a face mask is extremely important for performing some tasks, such as computer work, console monitoring, reading, and recognizing peripheral. In addition, the corner 111*b* and the corner 112*b* may also be curved as well, the present invention is not limited to the shape of the corner 111*b* and the corner 112*b*.

The opening 114 is located at middle of the sheet 110. Specifically, the opening 114 is located at an upper side of the central portion 113. The shape of the opening 114 in the present embodiment is semi-elliptical as an example. However, the present invention is not limited thereto. The opening 114 may be semi-racetrack-shaped, semi-circular, triangular, rectangular, square, etc., as long as at least a portion of a nose of a wearer can be exposed via the opening 114. Also, by additional 0.5-5.0 mm horizontal or oblique cuts or notches at the lateral side of the opening 114 may make the opening 114 better fit the curvature of the nose. As shown in FIG. 1, the opening 114 comprises an upper most portion 114*a* and a longest portion 114*b*. A width of the upper most portion 114*a* is greater than or equal to 0.25 inches. A longest length of the longest portion 114*b* is greater than or equal to 0.25 inches. It should be noted that the widest portion is not limited at a specific location. The upper most portion 114*a* in the present embodiment is the widest portion of the opening 114 as an example. However, the widest portion can be located anywhere at the opening 114.

FIG. 1 and FIG. 2A-2B show that the face mask 100 comprises multiple pleats 115 as an example. However, the present invention is not limited. The face mask 100 of the present invention may not comprise any pleat 115 or may only comprise one pleat 115 as long as the face mask 110 can work functionally.

Figure 3A:
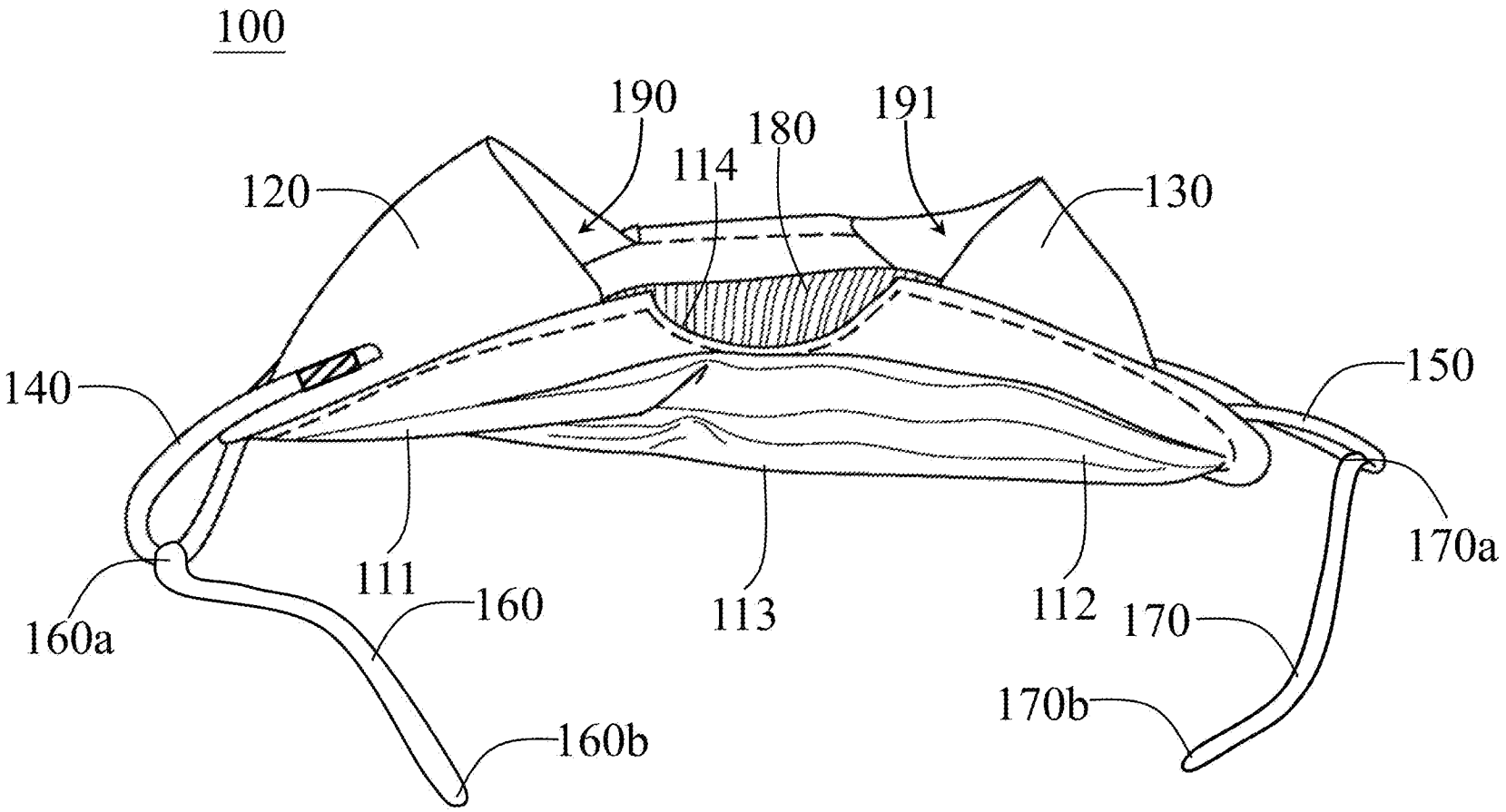
FIG. 3A shows a first chamber and a second chamber of the face mask in FIG. 2A according to the present embodiment.
Figure 3B:
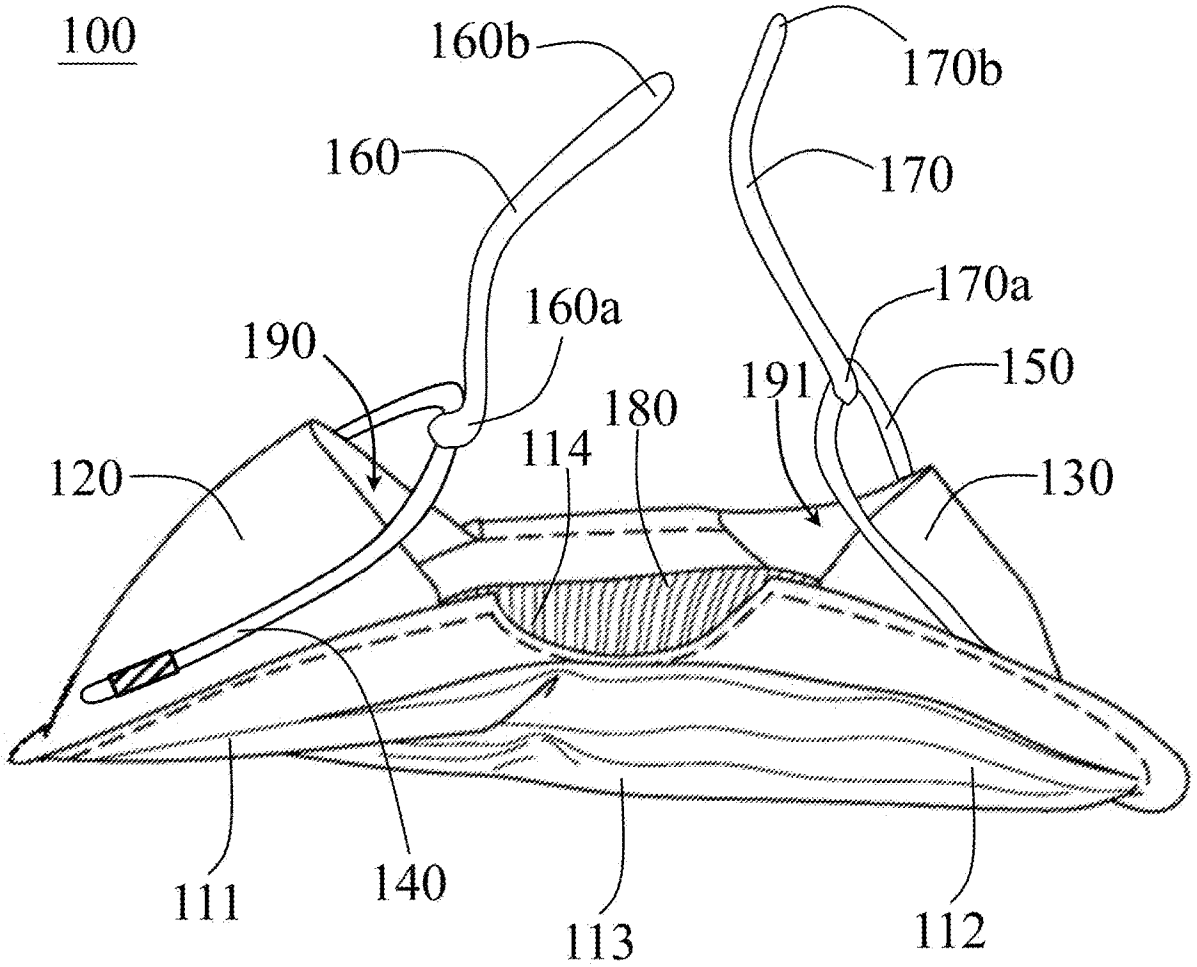
FIG. 3B shows a first chamber and a second chamber of the face mask in FIG. 2B according to the present embodiment.

FIG. 3A shows a first chamber 190 and a second chamber 191 of the face mask 100 in FIG. 2A according to the present embodiment. FIG. 3B shows a first chamber 190 and a second chamber 191 of the face mask 100 in FIG. 2B according to the present embodiment. Referring to FIGS. 1-3, the first lateral flap 120 is coupled to the first lateral portion 111 to form the first chamber 190. The second lateral flap 130 is coupled to the second lateral portion 112 to form the second chamber 191. The first loop 140 and the second loop 150 are coupled to the sheet 110. More precisely, the first loop 140 is coupled to the first lateral flap 120 then indirectly coupled to the first lateral portion 111 of the sheet 110, and the second loop 150 is coupled to the second lateral flap 130 then indirectly coupled to the second lateral portion 112 of the sheet 110. Therefore, in a worn state, the first loop 140 and the second loop 150 may cause the upper and lower ends of the face mask 100 to be led inward to approximate the face, allowing all edges of the face mask 100 to create a better seal. According to the present embodiment, the first loop 140 and the second loop 150 are ear loops but is not limited thereto. The loops are fixed on the lateral flaps and can be oriented either outwards or inwards. As shown on FIG. 2A and FIG. 3A, the first loop 140 and the second loop 150 are oriented outwards while ends thereof are fixed by bonding. Also, as shown on FIG. 2B and FIG. 3B, the first loop 140 and the second loop 150 are oriented inwards while ends thereof are fixed by bonding. In practice, the fixing method can be ultrasonic or thermocompression bonding or gluing, but not limited thereto. The first loop 140 and the second loop 150 can be manual tie-straps or combined as a headband as well.

Figure 4:
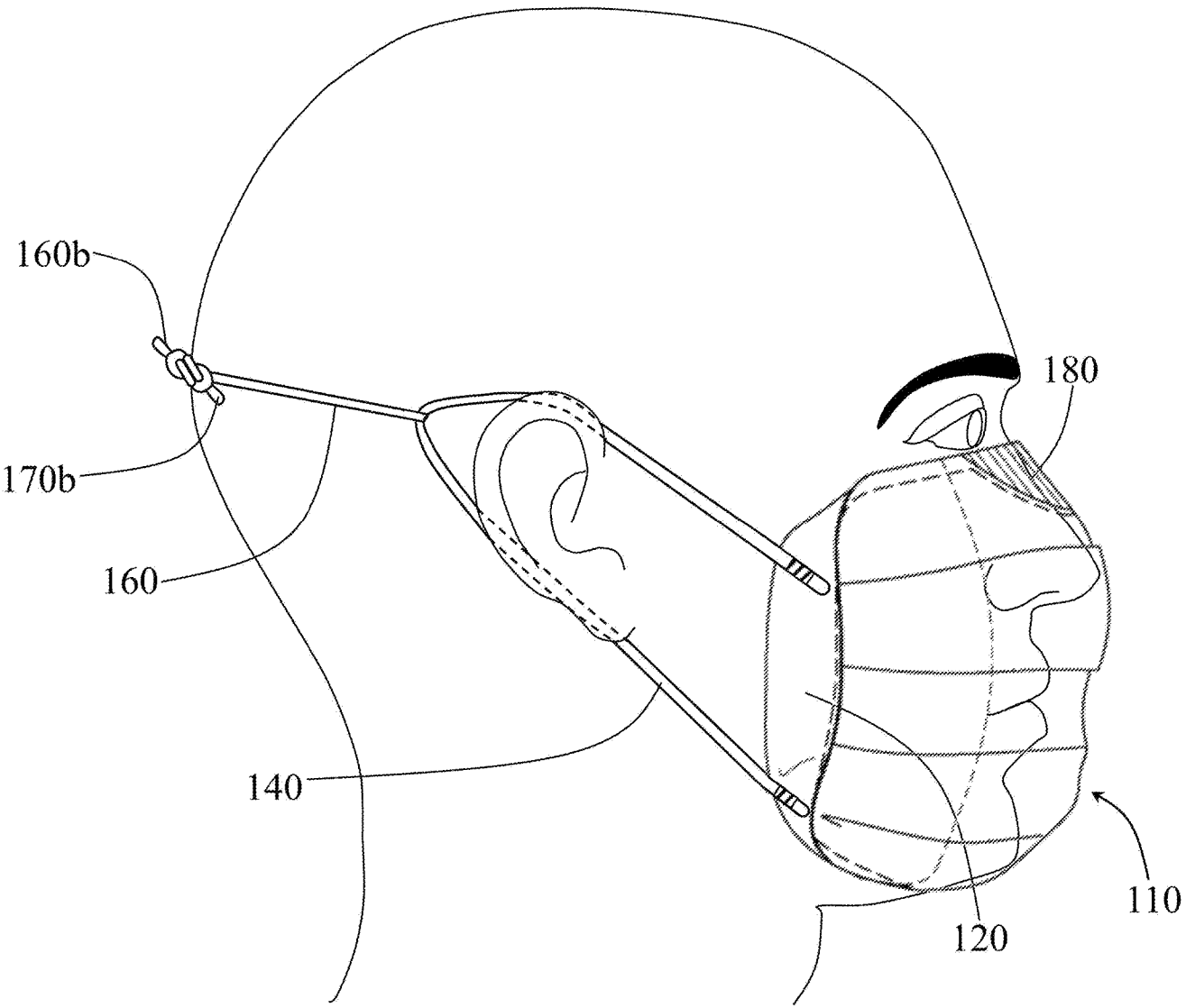
FIG. 4 illustrates the face mask in FIG. 1 is worn on the face.

According to the spirit of the present invention, the first loop 140 and the second loop 150 have further designs. The first loop 140 connects to the first strap 160. The second loop 150 connects to the second strap 170. In terms of form, the first strap 160 has a first connecting end 160*a* and a first loose end 160*b* and the second strap 170 has a second connecting end 170*a* and a second loose end 170*b*. The first connecting end 160*a* of the first strap 160 is movable in any position on the first loop 140. The first connecting end 160*a* moves along the direction as shown by the right double arrow arc in FIG. 2A. Similarly, the second connecting end 170*a* of the second strap 170 is movable in any position on the second loop 150. The second connecting end 170*a* moves along the direction as shown by the left double arrow arc in FIG. 2A. When the face mask 100 is worn as illustrated in FIG. 4, in addition to hanging the first loop 140 and the second loop 150 over the ears, the first loose end 160*b* of the first strap 160 on the first loop 140 and the second loose end 170*b* of the second strap 170 on the second loop 150 are capable of being tied to each other at the back of the wearer's head to ensure the best fit between the face and the face mask 100. The first strap 160 and the second strap 170 can be tied together by the first loose end 160*b* and the second loose end 170*b* at any angle behind the head. Such a design has many advantages. First, the first strap 160 and the second strap 170 absorb the tension in the first loop 140 and the second loop 150, respectively. Stress concentration doesn't happen on the pinna. Thus, pain from the stress on the pinna can be relieved. Secondly, the absorbed tension can not only tighten the tie of the first loose end 160*b* and the second loose end 170*b* but is widely spread over the back of head. Adjusting the location and tightness of the tie can make the straps more use flexibility for different kinds of head sizes.

In terms of materials, the first strap 160 and the second strap 170 are varied. The straps can be soft and conformable, the material may be non-woven, woven, fabrics, felts, foams, films, etc. If there are requirements of harder but flexible usages for the straps, the material may be plastics or elastics. According to the present invention, if the first strap 160 and the second strap 170 are made of an elastic material, then they are preferably to have elasticity of greater than or equal to that of the corresponding loop. In terms of appearance, the first strap 160 and the second strap 170 can be porous or non-porous. They can be in various shapes. It is not restricted by the prevent invention.

Figure 5:
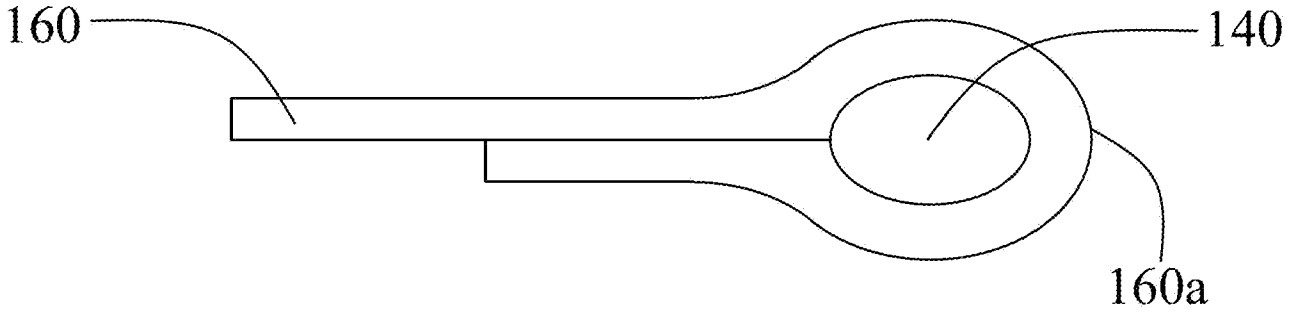
FIG. 5 illustrates a movably connecting end and a loose end of a first strap and a first loop.

As mentioned above, the materials used for the first strap 160 and the second strap 170 are varied. In the present invention, the straps are made of flat non-woven, flat fabrics, flat foams, flat plastic films, and braided elastics but are not limited thereto. In order to have a better understanding of the connecting of the first connecting end 160*a* of the first strap 160 and the first loop 140 as well as the connecting of the second connecting end 170*a* of the second strap 170 and the second loop 150, the former is taken as an example for illustration in FIG. 5. FIG. 5 is a sectional view along the line AA' on FIG. 1. After a piece of non-woven was cut to form the shape of the first strap 160, one end of the cut non-woven is folded to surround the first loop 140. Then, the folded end of the cut non-woven is bonded to the rest of the cut non-woven adjacent thereto. Bonding method may be ultrasonic bonding or thermocompression bonding or other bonding methods. Thus, the fold location of the cut non-woven forms the first connecting end 160*a*. The first loop 140 can move through a "hole" formed by the folded cut non-woven. Namely, the first connecting end 160*a* of the first strap 160 can be movable in any position on the first loop 140.

Figure 6:
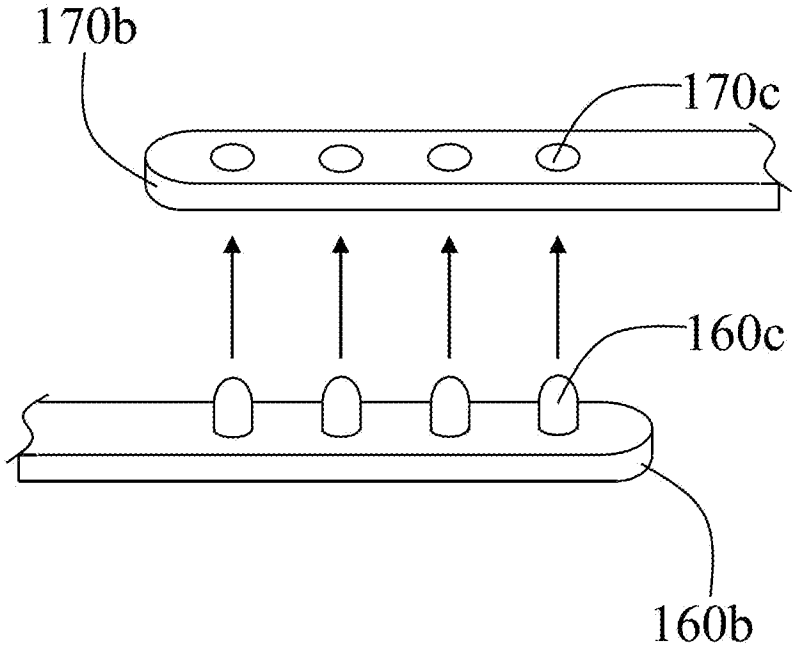
FIG. 6 shows a design of a first loose end and a second loose end when plastic material is applied.

When a harder material, e.g. polypropylene, is used to make the first strap 160 and the second strap 170, the first loose end 160*b* and the second loose end 170*b* need to have extra design around since they can not be bent to tie. One example is shown in FIG. 6. A number of protrusions 160*c* are formed near the first loose end 160*b*. A number of holes 170*c* are formed near the second loose end 170*b*. Each protrusion 160*c* can be inserted tightly into a corresponding hole 170*c* so that the first strap 160 and the second strap 170 are able to be removably bonded.

A convenient design for removably bonding the first loose end 160*b* and the second loose end 170*b* is disclosed in the present invention. It is required that at least one portion of the first strap 160 and the second strap 170 on one surface or both surfaces is coated with a self-adherent cohesive adhesive. The self-adherent cohesive adhesive is commercially available and used as a bonding material in a self-adherent bandage wrap. The self-adherent cohesive adhesive is designed to stick only to itself, not to the hair or skin. The self-adherent cohesive adhesive is pressure sensitive and removable. Namely, two objects with self-adherent cohesive adhesive coated can be bonded together when a bonding pressure is imposed to the contact surfaces of the two objects. Separation of the two objects is to exert a force in the opposite direction of the binding force. The two objects can be bonded again as long as the bonding pressure is imposed again. The self-adherent cohesive adhesive nay have a fast initial tack for successful initial cold seal. Use of self-adherent cohesive adhesive is for easily pasting or entangling the straps to each other to bond together to ensure the best fit of the face mask 100.

In order to achieve the ideal bonding effect, the first strap 160, the second strap 170 and the self-adherent cohesive adhesive need to have below restrictions. First, the coated self-adherent cohesive adhesive is preferably to provide a T-Peel strength of at least 0.1 lb/in for minimizing splitting while the face mask 100 is in the worn state. Secondly, the coated self-adherent cohesive adhesive provides an initial shear strength of at least 1 psi (lb/in$^2$) in 30 seconds to ensure successfully best fit of the face mask 100. At most, the wearer will hold the pasted first strap 160 and second strap 170 for three seconds and let them go. So, at least 1 psi of an initial shear strength for the straps in 30 seconds is required to ensure the best fit between the face mask 100 and the face. Thirdly, at least one portion of the first strap 160 and the second strap 170 has a width of greater than or equal to 025 inches. If the overall straps are too narrow, it means the quantity of self-adherent cohesive adhesive coated over the pasted area of the straps is less, causing the bonding force to reduce. Also, the wearer will feel difficult to handle the straps for bonding. Straps with a significantly larger width help to solve this problem. The harness device of a loop (first loop 140 and second loop 150) connecting a piece of a strap (first strap 160 and second strap 170) may provide secure and easy-to-wear functions. When the connecting straps are released from each other accidently, the face mask 100 may be still held on the wearer's face by the loops. Also, the first loop 140 and the second loop 150 may be put on ears first to allow the first strap 160 and the second strap 170 to be easily tied or joined together at the back of a head.

In order to have a better understanding of the application of the self-adherent cohesive adhesive on the first strap 160 and the second strap 170, some implementation designs will be described below.

Figure 7:
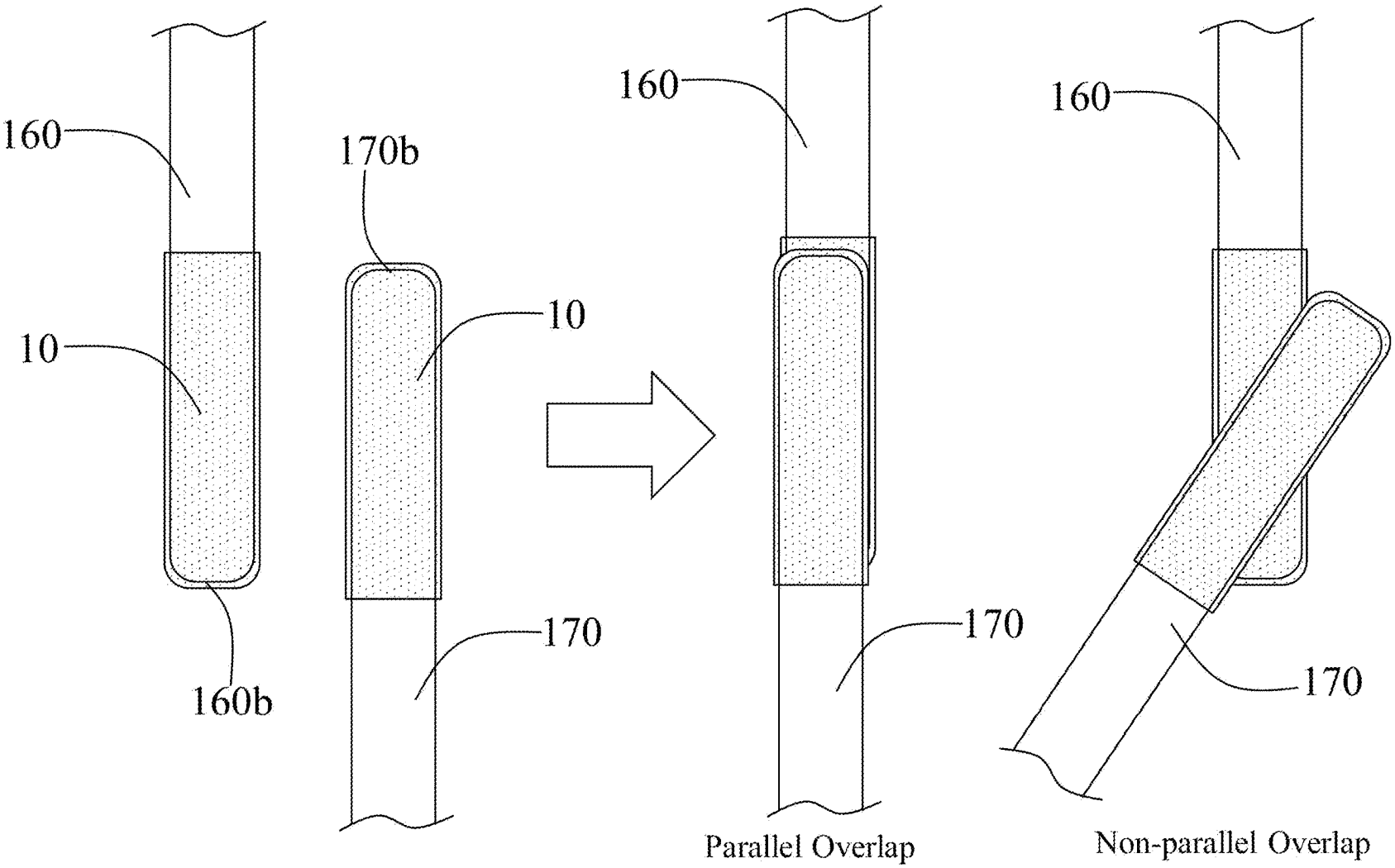
FIGS. 7-9 show implementation designs of the application of the self-adherent cohesive adhesive on a first strap and/or a second strap.

FIG. 7 shows a first application of the self-adherent cohesive adhesive on the first strap 160 and the second strap 170. The left and right sides of the arrow show the state before and after bonding, respectively. Coated self-adherent cohesive adhesive 10 is marked by dots. The self-adherent cohesive adhesive 10 is coated on a portion of one side or both sides of the first strap 160, including the first loose end 160*b* and adjacent area. Similarly, the self-adherent cohesive adhesive 10 is also coated on a portion of one side or both sides of the second strap 170, including the second loose end 170*b* and adjacent area. When bonding the straps, it is just to parallelly or non-parallelly overlap the coating area of the first strap 160 and the second strap 170 and press, the first strap 160 and the second strap 170 will be bonded together. To separate the straps, just tear the bonding area of the first strap 160 away from that of the second strap 170.

Figure 8:
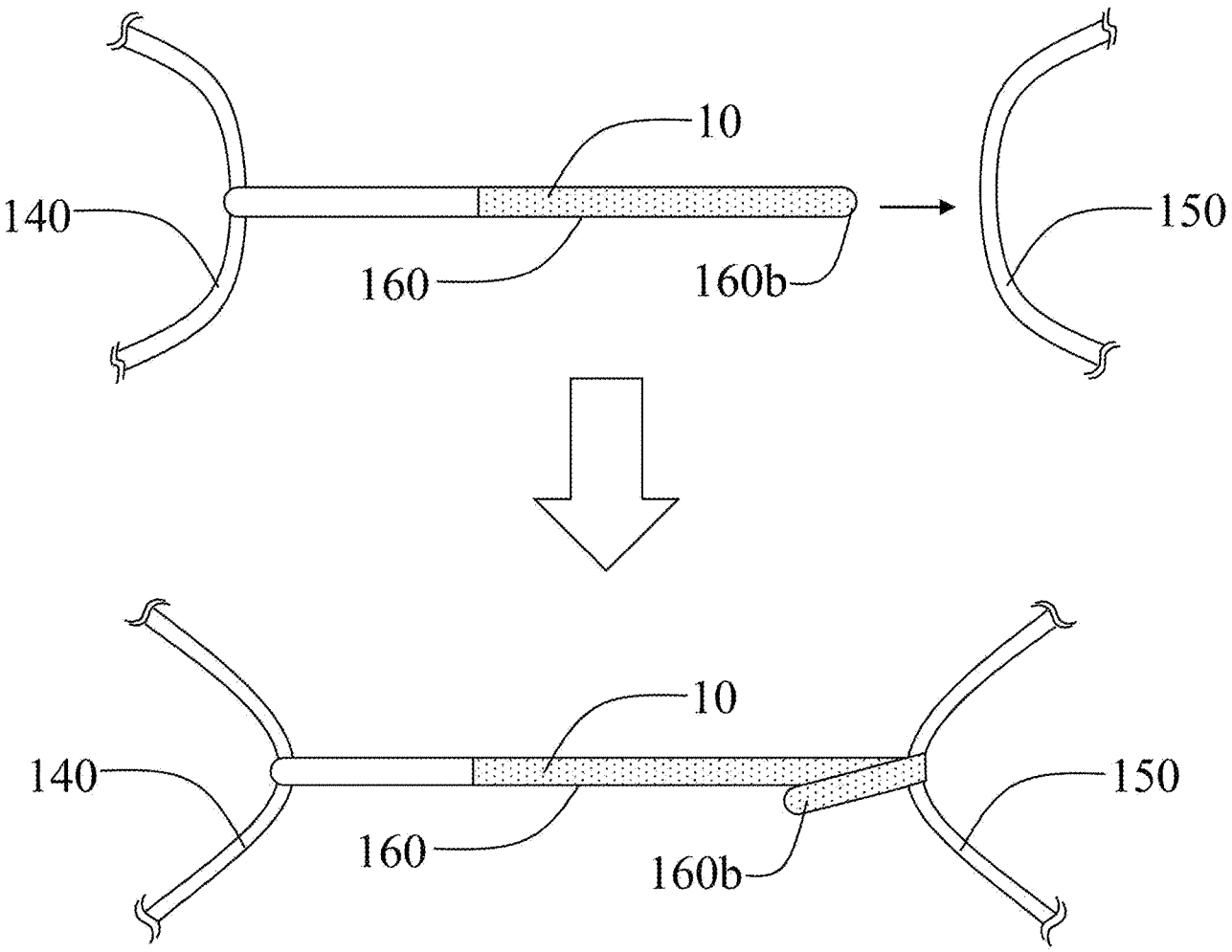

FIG. 8 shows a second application of the self-adherent cohesive adhesive on the first strap 160 or the second strap 170. The self-adherent cohesive adhesive 10 is coated on at least a portion of one side or both sides of the first strap 160, including the first loose end 160*b* and adjacent area. When bonding the first strap 160, the loose end 160*b* of the first strap 160 can be looped through the contralateral earloop, the second loop 150, and folded back on itself to self-adhere. The location of the first strap 160 at the back of the wearer's head when worn will be adjustable and the tightness can be adjusted to provide a better fit of the face mask 100 over the wearer's face. The application should be the same if the self-adherent cohesive adhesive 10 is on the second strap 170. However, there is not limited thereto, two or multiple lateral self-adherent straps can be utilized as well.

Figure 9:
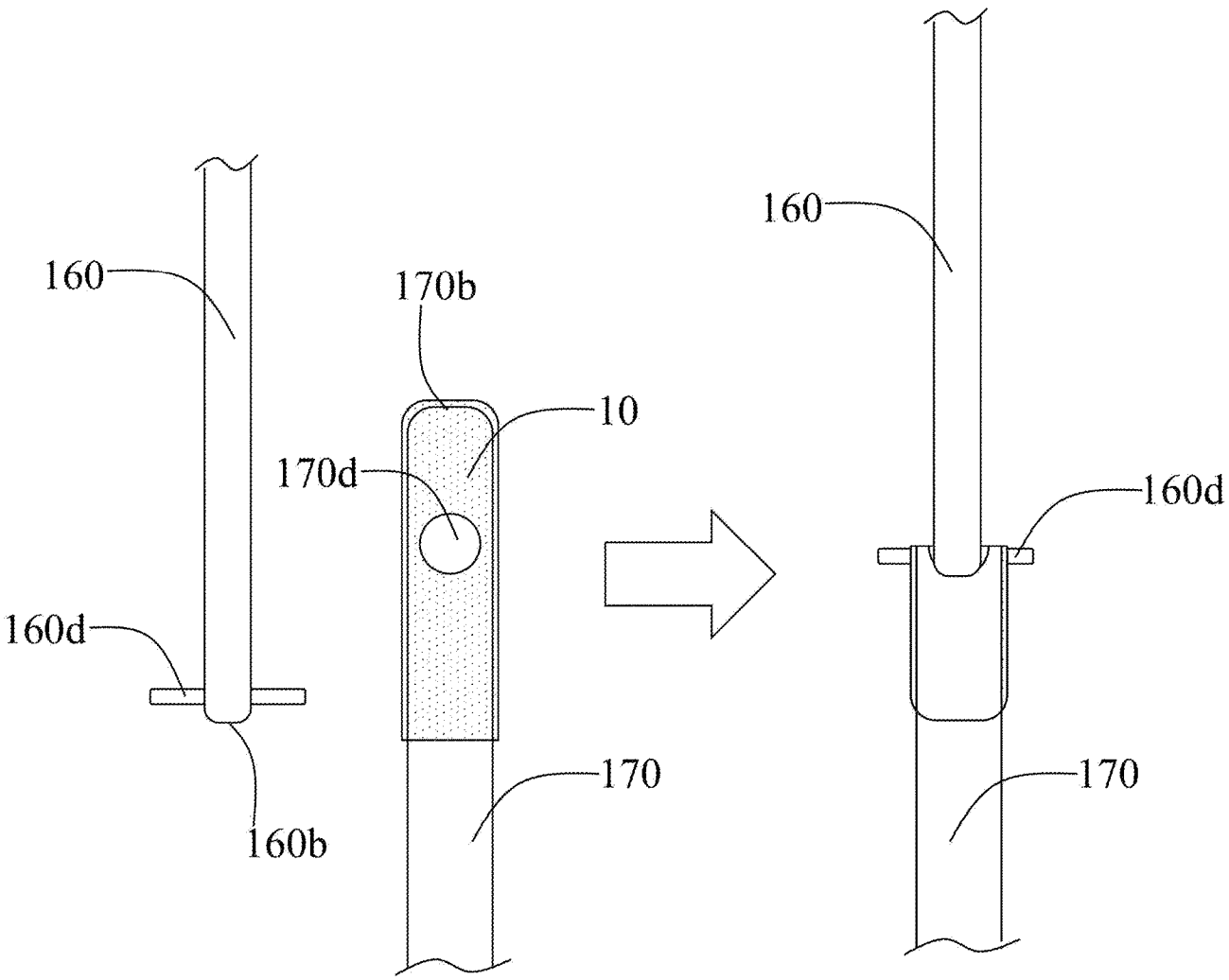

FIG. 9 shows a third application of the self-adherent cohesive adhesive on the first strap 160 or the second strap 170. The self-adherent cohesive adhesive 10 isn't coated on the first strap 160 but is coated on a one side of the second strap 170, including the second loose end 170*b* and adjacent area. A perforation 170*d* is formed in the second strap 170 where a side is coated with the self-adherent cohesive adhesive 10. The width of the first strap 160 is designed as narrow, at least the width of the first strap 160 should be less than the widest part of the perforation 170*d*. A rod 160*d* is fixed near the first loose end 160*b*. The rod 160*d* can rotate freely relative to the first strap 160. When bonding the straps, rotate the rod 160*d* to parallel to the direction of the first strap 160, pass the rod 160*d* and the first strap 160 through the perforation 170*d*, rotate rod 160*d* back to its original position, and fold the coating area of the second strap 170 to clamp the rod 160*d* and press. The number of the perforation 170*d* may be several for using for different head sizes. To separate the straps, execute the reverse procedure of bonding.

The elastic film 180 is coupled to the sheet 110 and covering the opening 114. Specifically, the sheet 110 may comprise an outer surface and an inner surface which is faced to the wearer. The elastic film 180 is coupled to the inner surface as an example but is not limited. The elastic film 180 can be coupled to the inner surface of the sheet 110 or any middle layer of the sheet 110 if the sheet 110 is a combination of multiple layers. The elastic film 180 is coupled to the sheet 110 at the periphery of the opening 114 of the sheet 110. The elastic film 180 may have prominent corrugations (toward the wearer's face) at the coupling region. The shape of the corrugations of the elastic film 180 can be various, such as waves, dots, or other shapes but is not limited thereto. Meanwhile, the elastic film 180 may be pressed to have prominent corrugations (toward the wearer's face) at non-coupling region but adjacent to the opening 114. The design is to improve the contacting tightness of the face mask 100 at the nasal area. The prominent corrugations (toward the wearer's face) will conjoin the skin at the nasal area more closely. For the same purpose, the elastic film 180 may simply have a polymeric coating with protrusions, waves, dots or other shapes. The polymeric coating materials can be polyolefin but is not limited thereto. The functions of the prominent corrugations and the polymeric coating include enhanced slip resistance and enhanced contacting tightness to the corresponding contacting skin. Furthermore, the elastic film 180 may be extended from the first lateral portion 111 to the second lateral portion 112 or only cover the opening 114 (referring to FIG. 2A and FIG. 2B). The present invention is not limited thereto. The elastic film 180 can be extended any distance at the face mask 100 as long as the elastic film 180 can cover the opening 114.

The elastic film 180 is stretchable. In detail, the elastic film 180 is configured to be stretched in at least one direction. Furthermore, the elastic film 180 may be an elastomeric film or an elastomeric laminate. The elastomeric film can be a mono layer elastomeric film or a multilayer elastomeric film. The elastomeric material of the elastomeric film can be but not limited to olefin-based elastomeric polymer, polyurethane etc. The elastomeric laminate can be composed of an elastomeric film and an elastic carrier, or be composed of an elastomeric film and a non-elastic carrier in which it needs further conducting the physical or chemical treatment. The carrier includes but not limited to polymer film, fabric, nonwoven fabric, woven fabric, or knitted fabric. By the structure of the opening 114 and the elastic film 180, the face mask 100 may be better fit onto the wearer's nose. As such, there is no gap appeared between the nose and the face mask 100 since the elastic film 180 is stretchable, preventing fog generation when wearing.

As shown in FIG. 2A, FIG. 2B, FIG. 3A and FIG. 3B, corners of the first lateral flap 120 and the second lateral flap 130 may be curved as the first lateral portion 111 and the second lateral portion 112. An inner edge of the first lateral flap 120 and an inner edge of the second lateral flap 130 which are closer to the central portion 113 may have different contour such as linear, concave, convex, irregular, etc. The variation in such contour has influence on the degree of contact between the face mask 100 and a corresponding portion of the wearer's face. As such, the contour of the inner edge of the first lateral flap 120 and the edge of the second lateral flap 130 may be modified according to different industry, the present application is not limited thereto.

Figure 10:
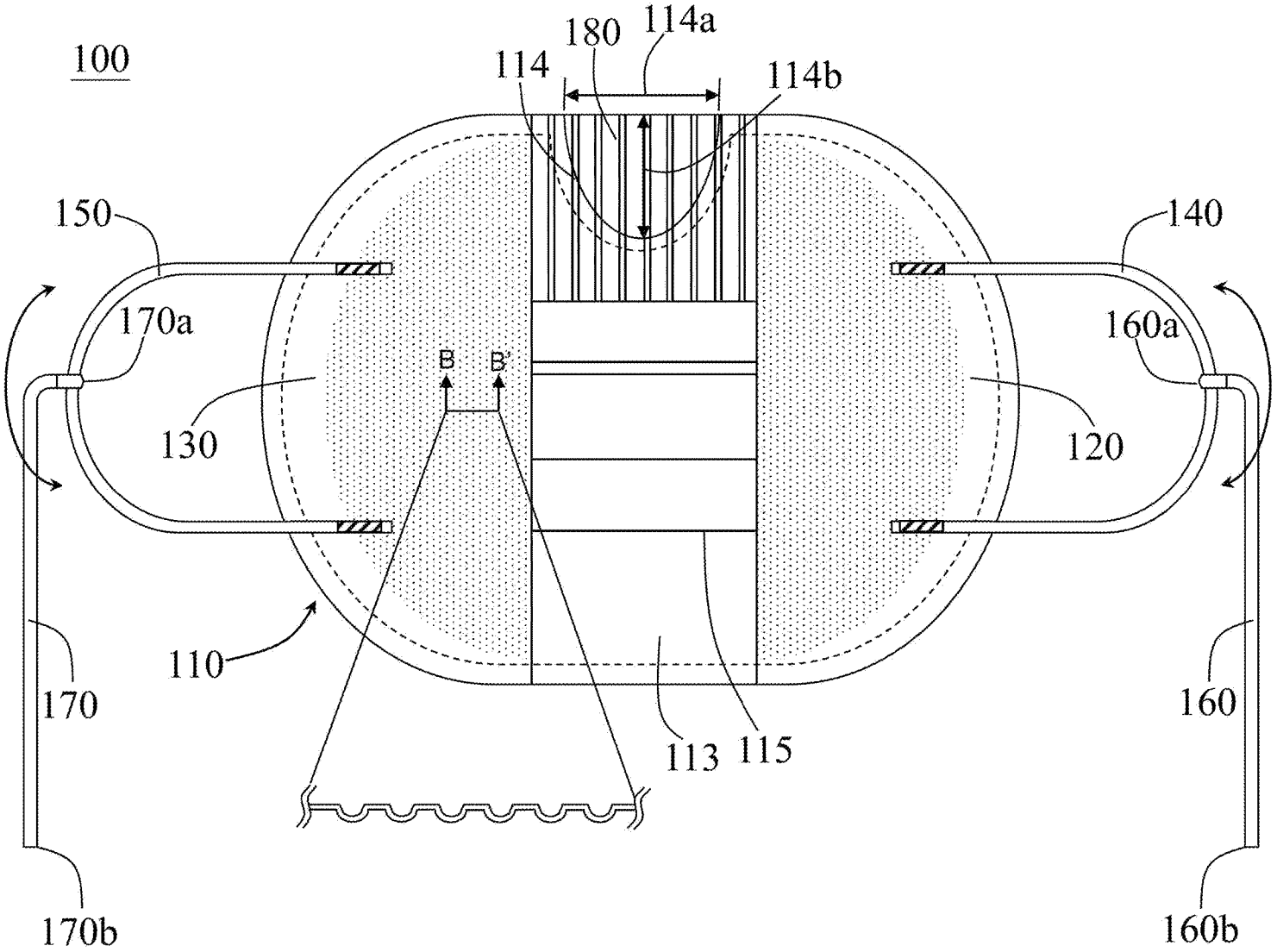
FIG. 10 shows prominent corrugations on the lateral flaps.

Although it is not shown in the drawings, the first lateral flap 120 and the second lateral flap 130 may comprise at least one peripheral fold and/or at least one pleat to create enhanced contacting tightness between the face mask 100 and a corresponding portion of the wearer's face. In addition, for the same purpose, the lateral flap materials, such as nonwoven, woven fabrics, fabrics, felts, films and foams, can be wrinkled/crepe on the surface in contact with the skin. As shown in FIG. 10, the first lateral flap 120 and the second lateral flap 130 may have prominent corrugations where their surfaces potentially contact the skin surface of the face. The prominent corrugations can be generated via a convex-concave embossed roller pressing process. The corrugated shape is dots and may be waves, or other shapes in practice. Also, the lateral flaps may have a prominent polymeric coating with waves, dots or other shapes. The polymeric coating materials can be polyolefin but is not limited thereto. The function of the prominent corrugations or the prominent polymeric coating is to create enhanced contacting tightness of the first lateral flap 120 and the second lateral flap 130 to the corresponding contacting skin at the cheek area while it is in the worn state.

The first lateral flap 120 and the second lateral flap 130 may comprise filtering material or non-breathable material.

The filtering material can be but not limited to a conventional, corrugated and stretchable material. Other designs, for example, a design of not used any thermoplastic elastomer material or of rubber disclosed in China Patent No. CN1349570A, may be applied, as well. The non-breathable material can be a polymeric film or a polymeric film with a nonwoven fabric laminate, in which it can be but not limited to a conventional, corrugated and stretchable material, or an elastic film/laminate. Using said material for making the first lateral flap 120 and the second lateral flap 130 can make the longitudinal length of the face mask 100 expandable to fit a wider range of wearers. Furthermore, by adding horizontal or oblique cuts or notches at the inner edge (close to the central portion 113) of the lateral flaps can achieve the longitudinal length of the face mask 100 expandable too when wearing it. However, the present invention is not limited thereto as long as the first chamber 190 and the second chamber 191 can be formed. The polymeric film described herein includes elastic polymeric film.

Figure 11A:
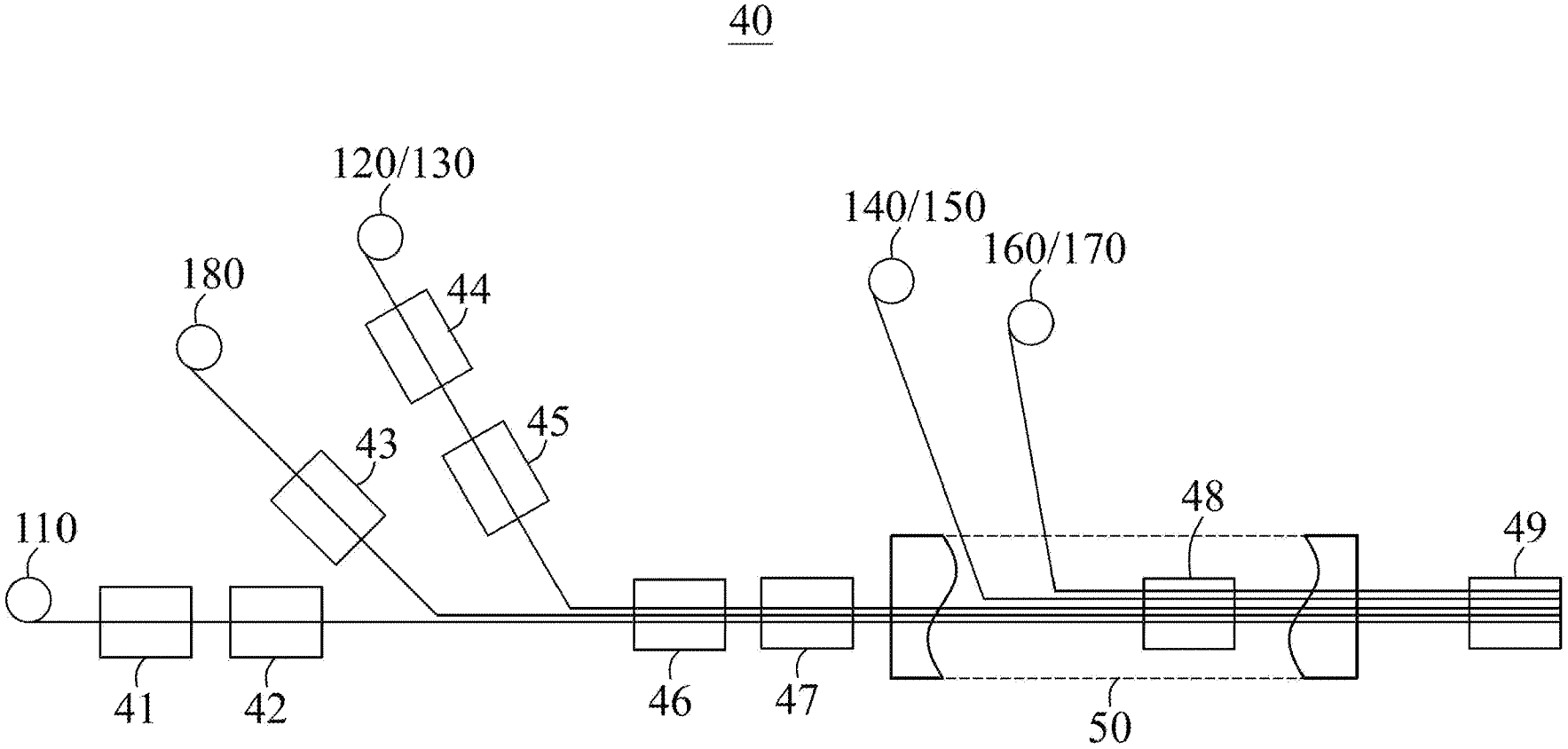
FIGS. 11A-11C are views showing a method of manufacturing the face mask of the embodiment.
Figure 11B:
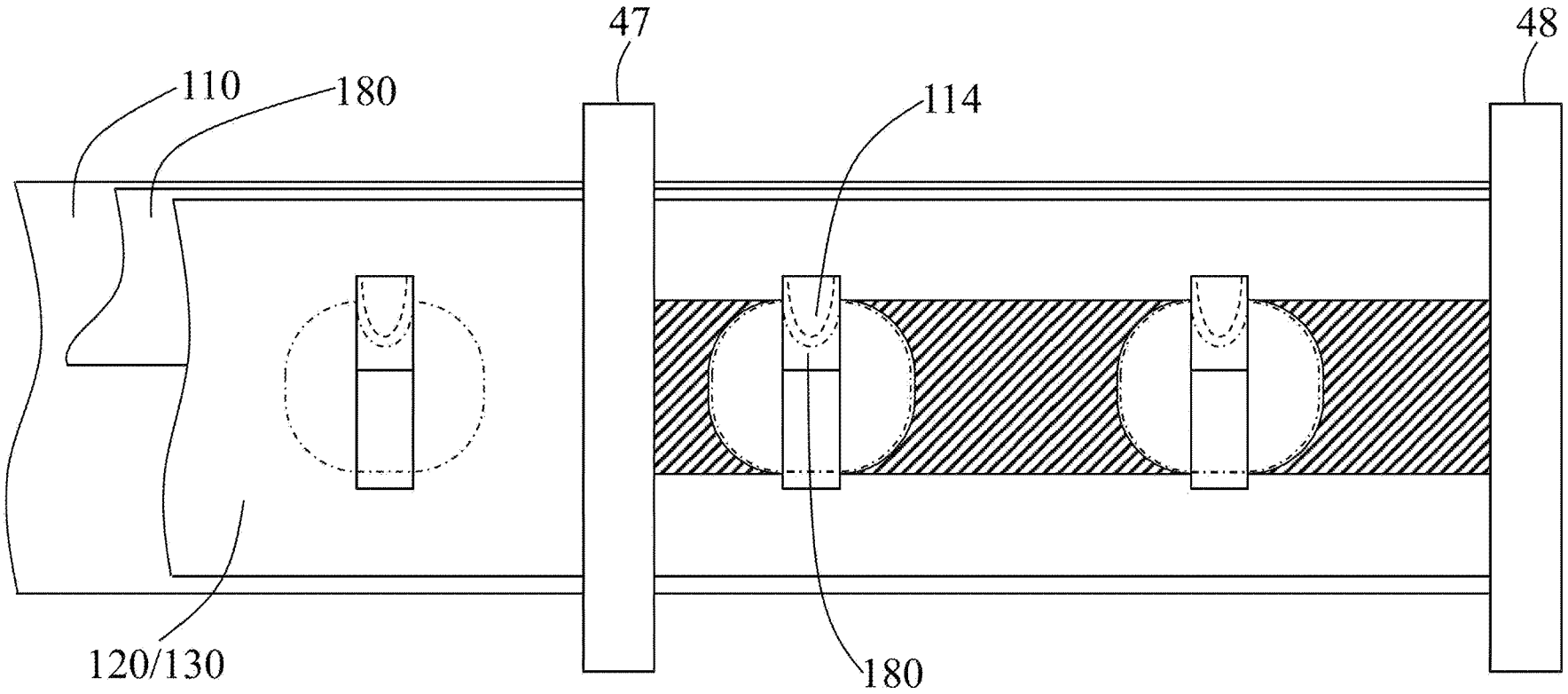
Figure 11C:
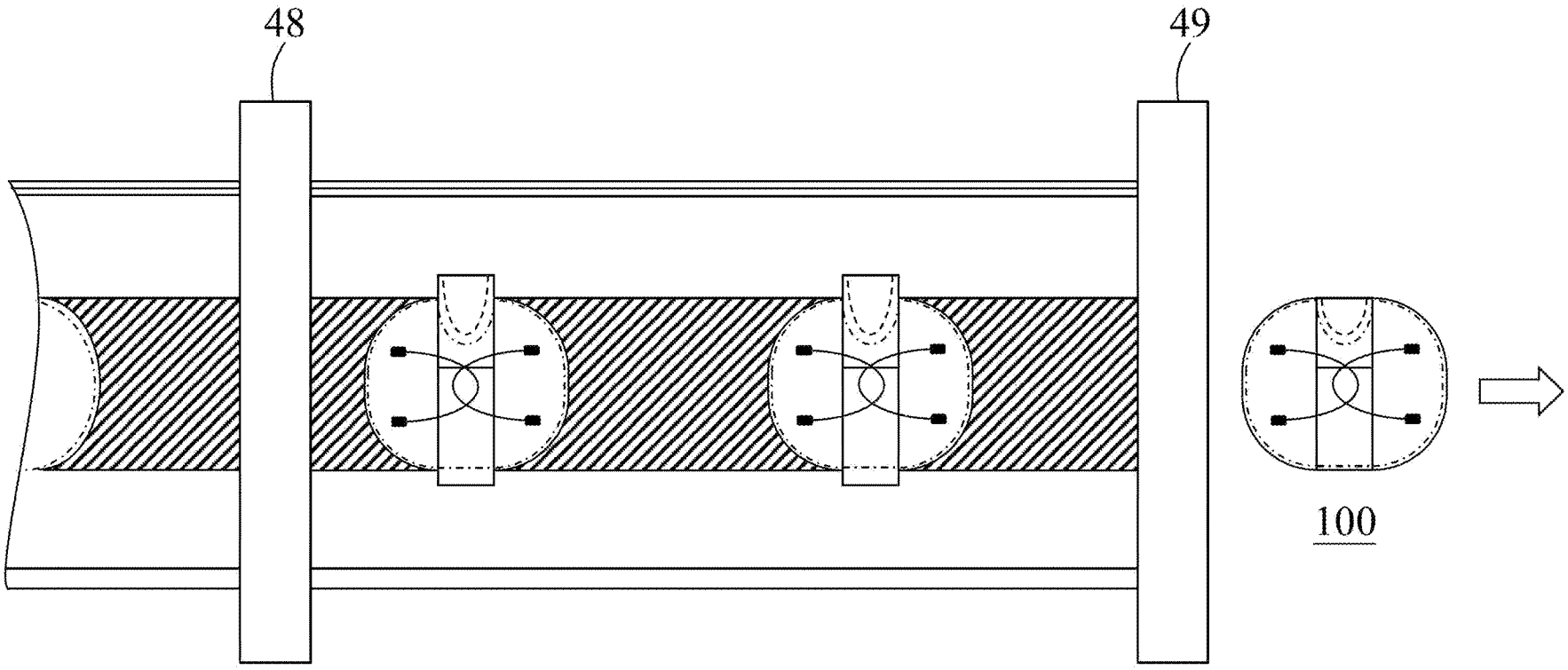

FIGS. 11A-11C are views showing a method of manufacturing the face mask of 100. Referring to FIG. 1, FIG. 11A, FIG. 11B and FIG. 11C, a manufacture system 40 comprises a pleating station 41, a first die-cut station 42, an integrated laminating station 43, an embossing rolling station 44 (optional), a second die-cut station 45, a bonding station 46, a third die-cut station 47, an earloop welding station 48, a fourth die-cut station 49 and a welding auxiliary station 50.

The material of the sheet 110 is prepared and passed to the pleating station 41. However, if the face mask 100 does not comprise pleats, pleating station 41 may be omitted. The material of the sheet 110 is cut to form the opening 114 via the first die-cut station 42. The materials of the elastic film 180 are laminated via the integrated laminating station 43. The materials for the first lateral flap 120 and the second lateral flap 130 are prepared by passing through the embossing rolling station 44 before passed to the second die-cut station 45. However, if the face mask 100 does not need the embossed characteristics, this step may be omitted. In the field of elastic materials, it is well known that to wind a machine-directional stretch elastic material is difficult. One problem is winding without stretching it very much causing a loose roll. Another problem is that it is too tightly stretched during winding, which can cause stickiness between layers and it is not easy to unwind later. These winding issues are the reason for integrating the manufacture of the machine-directional stretch elastic materials (such as MD stretch elastic laminates) into the main manufacturing process. According to a traditional manufacturing method of the MD stretch elastic laminate, it is to stretch an elastic film. While the elastic film is stretched, a nonwoven or film is attached thereto. Then the laminate is allowed to relax. The wrinkled/crepe-like texture of the resulting stretch elastic laminate functions similarly to the prominent corrugations that allow for the fitting of the nasal area more closely.

The second die-cut station 45 cuts the material for the first lateral flap 120 and the second lateral flap 130 to have at least one open configuration. The open configuration is a rectangular configuration as an example. However, the present application is not limited thereto. The open configuration can be any kind of shape according to the contour of the first lateral flap 120 and the second lateral flap 130. After which, the material of the sheet 110, the material of the elastic film 180 and the material for the first lateral flap 120 and the second lateral flap 130 are coupled together via the bonding station 46. As shown in FIG. 11B, the extraneous material of the sheet 110, the material of the elastic film 180 and the material for the first lateral flap 120 and the second lateral flap 130 are cut off at the lateral aspects via the third die-cut station 47. The resulting product remains connected to the respective layers of raw sheets at the superior and inferior aspects to allow for continuous movement through the rollers in a production line and to facilitate the next manufacturing step of welding of the earloop.

At the other side, the first loops 140 and the second loops 150 with desired length are cut and coupled to the sheet 110 via coupling them to the first lateral flap 120 and the second lateral flap 130 at a commercial available automatic face mask earloop welding station. Going one step further, an improved automatic face mask earloop welding station 48 can integrate the strap attachment procedure into the main earloop welding process. Resulting in the welding station 48 where the first loop 140 connecting to a first strap 160 and the second loop 150 connecting to a second strap 170 are coupled to the sheet 110 via coupling them to the first lateral flap 120 and the second lateral flap 130, respectively. Finally, a complete face mask 100 is manufactured at the fourth die-cut station 49 as shown in FIG. 11C.

One thing needs to be mentioned in particular in this manufacturing process. That is, there is a need for a synchronous conveyor belts system equipped with anvils which insert into and prop open the lateral chambers of the semi-finished face mask while the mask is in transit. A workstation 50 is a pair of synchronous conveyor belts on the lateral sides of the production line that cycle simultaneously but independently with workstation 48. The anvils are installed bilaterally on the paired conveyor belts. The system allows the anvils to insert automatically (or be triggered) into the lateral chambers of the semi-finished mask while the mask is in transit. These anvils, after entering the synchronous workstation 48, can provide the necessary counter-pressure required in ultrasonic welding process. After leaving the workstation 48, the anvils on the paired conveyer belts are automatically (or be triggered) extracted out of the mask and cycled back to the beginning of workstation 50.

Based on the operation of the manufacture system 40, a method of manufacturing the face mask 100 may have below steps. A first step of the method is cutting the sheet 110 to form the central portion 113, the first lateral portion 111, the second lateral portion 112 and the opening 114 (S01). Then, a second step of the method is coupling the elastic film 180 to the sheet 110 to cover the opening 140 (S02). A third step of the method is coupling the first lateral flap 120 to the first lateral portion 111 to form the first chamber 190, and the second lateral flap 130 to the second lateral portion 112 to form the second chamber 191 (S03). Then, a fourth step of the method is coupling the first loop 140 connecting to a first strap 160 to the sheet 110 via coupling to the first lateral flap 120, and the second loop 150 connecting to a second strap 170 to the sheet 110 via coupling to the second lateral flap 130 (S04). Additionally, after the step S02, there may be an optional step: pressing the elastic film 180 to have prominent corrugations at a non-coupling region but adjacent to the opening 114. Also, before the step S03, there may be another optional step: pressing the first lateral flap 120 and the second lateral flap 130 to have prominent corrugations at the region that the lateral flaps may potentially contact the face-skin.

According to the present invention, the number of the first strap 160 is not limited to one. The number can be at least one. Similarly, the number of the second strap 170 is also not limited to one. The number can be at least one. Another embodiment below is used to illustrate such arrangement.

Figure 12:
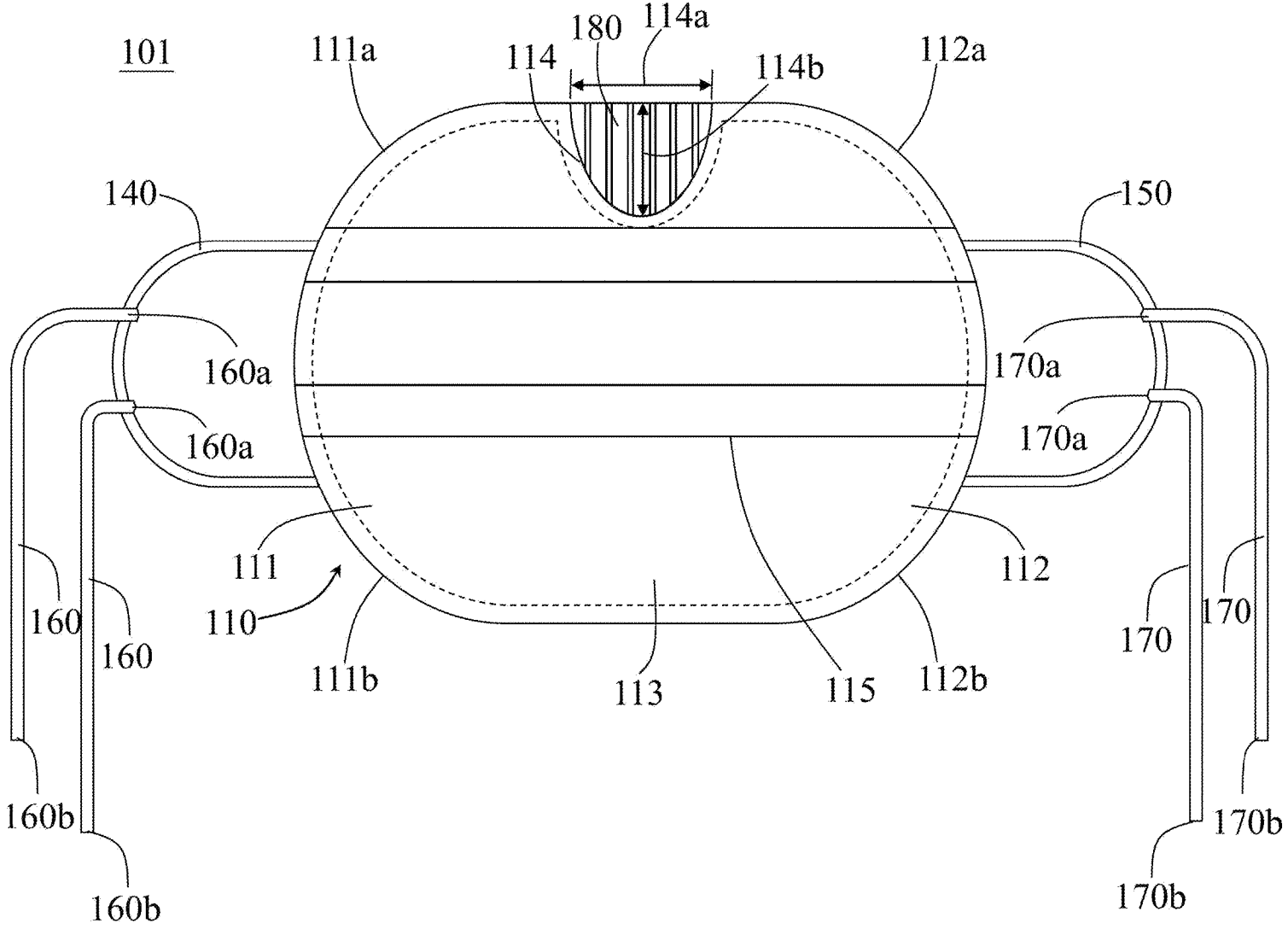
FIG. 12 is a front view of a face mask according to another embodiment.
Figure 13:
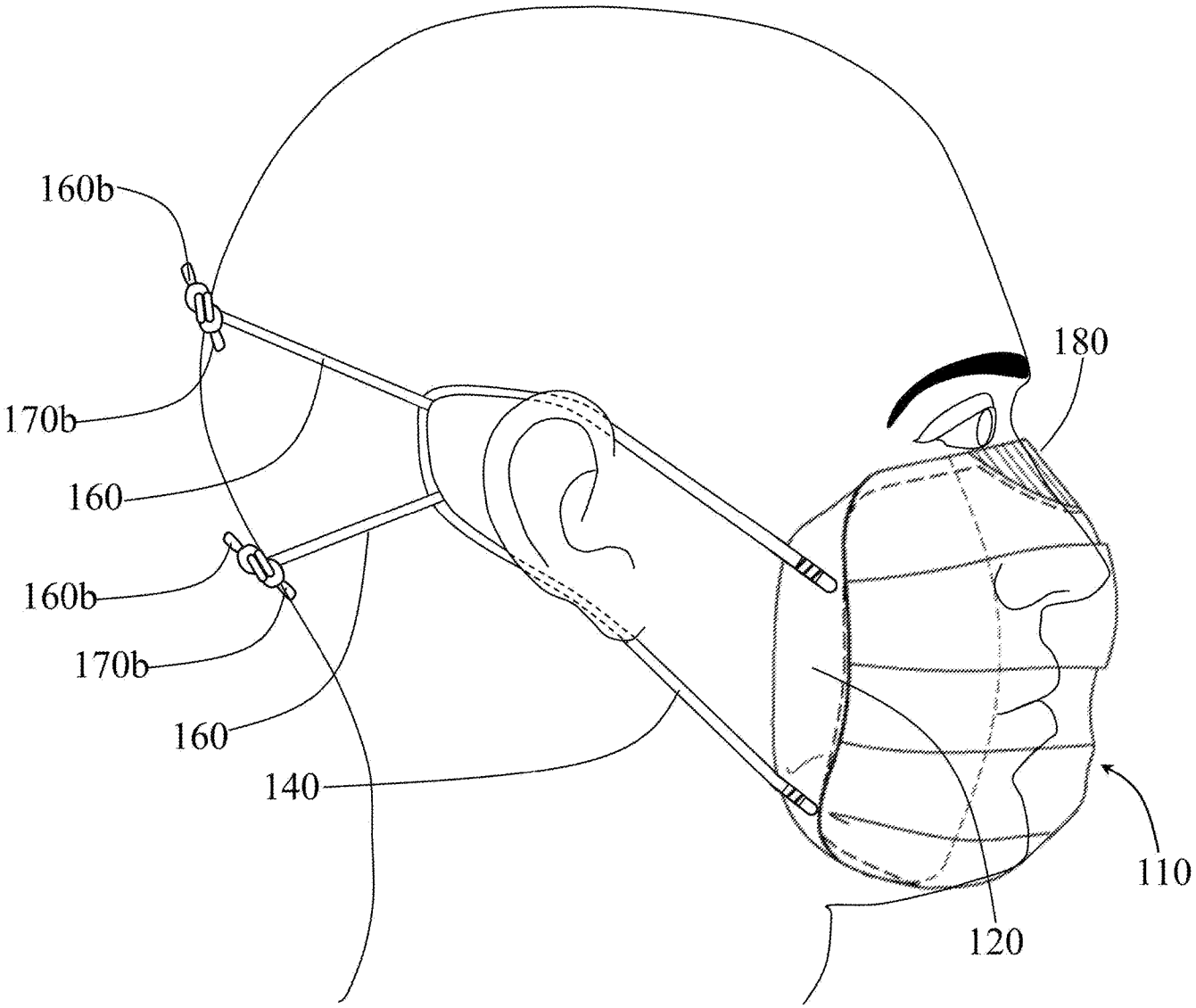
FIG. 13 illustrates the face mask in FIG. 12 is worn on the face.

FIG. 12 is a front view of a face mask 101 according to another embodiment. FIG. 13 illustrates the face mask 101 is worn on the face. The face mask 101 and the face mask 100 have commonly used parts. The same symbol represents the same part and the function and corresponding connection method of this part are omitted and will not be repeated here. The differences between FIG. 1 and FIG. 12 are that there are two first straps 160 and two second straps 170 in FIG. 12. The two first straps 160 and two second straps 170 can all be movable in any position on the first loop 140 and the second loop 150, respectively. Therefore, as shown on FIG. 13, each pair of the first strap 160 and the second strap 170 can be tied to at the back of the wearer's head. The stress on the ears of the wearer can be further shared by two ties of straps. It works like a surgical mask and provides more use flexibility to ensure the best fit of the face mask on the face of wearers of various head sizes. Of course, in other embodiment, the number of pairs of straps may be more than 2.

The designs of the face mask 100 are diverse. Specific types may be available from U.S. Pat. No. 11,122,841, which is the invention provided by the same inventor. No more illustrations on this in the present invention.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims, which are to be accorded with the broadest interpretation so as to encompass all such modifications and similar structures.

What is claimed is:

1. A face mask comprising:

a sheet comprising a central portion, a first lateral portion, a second lateral portion and an opening;

a first lateral flap coupled to the first lateral portion to form a first chamber;

a second lateral flap coupled to the second lateral portion to form a second chamber;

a first loop connecting to a first strap, the first loop being coupled to the first lateral flap;

a second loop connecting to a second strap, the second loop being coupled to the second lateral flap; and an elastic film coupled to a sheet and covering the opening.

2. The face mask according to claim 1, wherein the material of the straps is non-woven, woven, fabrics, felts, foams, films, plastics or elastics.

3. The face mask according to claim 1, wherein the straps are porous or non-porous.

4. The face mask according to claim 1, wherein a first connecting end of the first strap is movable in any position on the first loop.

5. The face mask according to claim 1, wherein a second connecting end of the second strap is movable in any position on the second loop.

6. The face mask according to claim 1, wherein a first loose end of the first strap on the first loop and a second loose end of the second strap on the second loop are capable of being tied to each other at the back of the wearer's head to ensure the best fit between the face and the face mask.

7. The face mask according to claim 1, wherein at least one portion of the straps on one surface or both surfaces is coated with a self-adherent cohesive adhesive.

8. The face mask according to claim 7, wherein the self-adherent cohesive adhesive is pressure sensitive and removable.

9. The face mask according to claim 7, wherein at least one portion or the straps has a width of greater than or equal to 0.25 inches.

10. The face mask according to claim 7, wherein the coated self-adherent cohesive adhesive has a fast initial tack for successful initial cold seal.

11. The face mask according to claim 7, wherein the coated self-adherent cohesive adhesive provides a T-Peel strength of at least 0.1 lb/in.

12. The face mask according to claim 7, wherein the coated self-adherent cohesive adhesive provides an initial shear strength of at least 1 psi in 30 seconds.

13. The face mask according to claim 2, wherein each strap has an elasticity of greater than or equal to that of the corresponding loop when the straps are made of an elastic material.

14. The face mask according to claim 1, wherein the number of the first strap is at least one.

15. The face mask according to claim 1, wherein the number of the second strap is at least one.

16. The face mask according to claim 1, wherein the elastic film is coupled to the sheet at the periphery of the opening of the sheet, and the elastic film has prominent corrugations at the coupling region, the elastic film is pressed to also have other prominent corrugations at a non-coupling region but adjacent to the opening in order to improve the contacting tightness of the face mask at the nasal area.

17. The face mask according to claim 1, wherein the lateral flaps have prominent corrugations to improve contacting tightness of the face mask at the cheek area.

18. A method of manufacturing the face mask of claim 1, comprising: cutting the sheet to form the central portion, the first lateral portion, the second lateral portion and the opening;

coupling the elastic film to the sheet to cover the opening;

coupling the first lateral flap to the first lateral portion to form the first chamber, and the second lateral flap to the second lateral portion to form the second chamber; and coupling the first loop connecting to a first strap to the sheet via coupling to the first lateral flap, and the second loop connecting to a second strap to the sheet via coupling to the second lateral flap.

19. The method of manufacturing the fact mask as claimed in claim 18, wherein after coupling the elastic film to the sheet to cover the opening, the method further comprises:

pressing the elastic film to have prominent corrugations at a non-coupling region but adjacent to the opening.

20. The method of manufacturing the face mask as claimed in claim 18, wherein before coupling the first lateral flap to the first lateral portion to form the first chamber, and the second lateral flap to the second lateral portion to form the second chamber, the method bather comprises:

pressing the first lateral flap and the second lateral flap to have prominent corrugations at the region that the lateral flaps may potentially contact the face-skin.

* * * * *